US006444151B1

(12) United States Patent
Nguyen et al.

(10) Patent No.: US 6,444,151 B1
(45) Date of Patent: Sep. 3, 2002

(54) APPARATUS AND PROCESS FOR SPINNING POLYMERIC FILAMENTS

(75) Inventors: Young D. T. Nguyen, Charlottesville, VA (US); Hans R. Frankfort, Kinston; Gregory Eugene Sweet, Greenville, both of NC (US); George Vassilatos, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/547,854

(22) Filed: Apr. 12, 2000

Related U.S. Application Data

(60) Provisional application No. 60/129,412, filed on Apr. 15, 1999.

(51) Int. Cl.[7] ..... D01D 5/092

(52) U.S. Cl. ..... 264/101; 264/211.14; 264/211.15; 264/237; 425/72.2; 425/378.2; 425/379.1; 425/382.2; 425/464

(58) Field of Search ..... 264/101, 211.14, 264/211.15, 237; 425/72.2, 378.2, 379.1, 382.2, 464

(56) References Cited

U.S. PATENT DOCUMENTS 2,604,667 A * 7/1952 Hebler et al.
4,156,071 A * 5/1979 Knox
4,687,610 A * 8/1987 Vassilatos
4,691,003 A * 9/1987 Sze
5,034,182 A * 7/1991 Sze et al.
5,141,700 A * 8/1992 Sze
5,250,245 A * 10/1993 Collins et al.
5,288,557 A * 2/1994 Collins et al.
5,824,248 A * 10/1998 Sweet et al.
5,976,431 A * 11/1999 Mears

FOREIGN PATENT DOCUMENTS

| | | |
|---|---|---|
| EP | 0 244 217 A2 | 11/1987 |
| EP | 0 334 604 A2 | 10/1989 |
| WO | WO 95 15409 A1 | 6/1995 |
| WO | WO 00 05439 A1 | 2/2000 |

OTHER PUBLICATIONS

Abstract of Japan 60–246807 (Published Dec. 6, 1985).
Abstract of Japan 62–184107 (Published Aug. 12, 1987).

* cited by examiner

*Primary Examiner*—Leo B. Tentoni
(74) *Attorney, Agent, or Firm*—Charles E. Krukiel

(57) ABSTRACT

A melt spinning apparatus for spinning continuous polymeric filaments including a first stage gas inlet chamber adapted to be located below a spinneret and optionally a second stage gas inlet chamber located below the first stage gas inlet chamber. The gas inlet chambers supply gas to the filaments to control the temperature of the filaments. The melt spinning apparatus also includes a tube located below the second stage gas inlet chamber for surrounding the filaments as they cool. The tube may include an interior wall having a converging section, optionally followed by a diverging section.

20 Claims, 13 Drawing Sheets

APPARATUS AND PROCESS FOR SPINNING POLYMERIC FILAMENTS

RELATED APPLICATIONS

This application claims priority from and incorporates by reference in its entirety, provisional application No. 60/129,412 filed Apr. 15, 1999.

BACKGROUND OF THE INVENTION

The invention relates to processes and apparatus for melt spinning polymeric filaments at high speeds, for example over 3,500 meters per minute (mpm) for polyester filaments.

Most synthetic polymeric filaments, such as polyesters, are melt-spun, i.e., they are extruded from a heated polymeric melt. In current processes, after the freshly extruded molten filamentary streams emerge from the spinneret, they are quenched by a flow of cooling gas to accelerate their hardening. They can then be wound to form a package of continuous filament yarn or otherwise processed, e.g., collected as a bundle of parallel continuous filaments for processing, e.g., as a continuous filamentary tow, for conversion, e.g., into staple or other processing.

It has long been known that polymeric filaments such as polyesters, can be prepared directly, i.e., in the as-spun condition, without any need for drawing, by spinning at high speeds of the order of 5 km/nin or more. Hebeler disclosed this for polyesters in U.S. Pat. No. 2,604,667.

There have been essentially two basic types of quench systems in general commercial use. Cross-flow quench has been favored and used commercially. Cross-flow quench involves blowing cooling gas transversely across and from one side of the freshly extruded filamentary array. Much of this cross-flow air passes through and out the other side of the filament array. However, depending on various factors, some of the air may be entrained by the filaments and be carried down with them towards a puller roll, which is driven and is usually at the base of each spinning position. Cross-flow has generally been favored by many fiber engineering firms as puller roll speeds (also known as "withdrawal speeds" and sometimes referred to as spinning speeds) have increased because of a belief that "cross-flow quench" provides the best way to blow the larger amounts of cooling gas required by increased speeds or through-put.

Another type of quench is referred to as "radial quench" and has been used for commercial manufacture of some polymeric filaments, e.g., as disclosed by Knox in U.S. Pat. No. 4,156,071, and by Collins, et al. in U.S. Pat. Nos. 5,250,245 and 5,288,553. In this type of "radial quench" the cooling gas is directed inwards through a quench screen system that surrounds the freshly extruded filamentary array. Such cooling gas normally leaves the quenching system by passing down with the filaments, out of the quenching apparatus. Although, for a circular array of filaments, the term "radial quench" is appropriate, the same system can work essentially similarly if the filamentary array is not circular, e.g., rectangular, oval, or otherwise, with correspondingly-shaped surrounding screen systems that direct the cooling gas inwards towards the filamentary array.

In the 1980's, Vassilatos and Sze made significant improvements in the high-speed spinning of polymeric filaments and disclosed these and the resulting improved filaments in U.S. Pat. Nos. 4,687,610, 4,691,003, 5,141,700, and 5,034,182. These patents describe gas management techniques, whereby gas surrounded the freshly extruded filaments to control their temperature and attenuation profiles. While these patents describe breakthroughs in the field of high-speed spinning, there is a continuing desire to increase yarn-spinning productivity through increased withdrawal speeds, while maintaining at least comparable or improved yarn properties.

SUMMARY OF THE INVENTION

In accordance with these needs there is provided processes and apparatuses for spinning polymeric filaments.

Accordingly to one aspect of the present invention, there is provided a melt spinning apparatus for spinning continuous polymeric filaments, comprising:

a first stage gas inlet chamber adapted to be located below a spinneret and a second stage gas inlet chamber located below the first stage gas inlet chamber wherein the first and second stage gas inlet chambers supply gas to the filaments to control temperature of the filaments; and a tube located below the second stage gas inlet chamber for surrounding the filaments as they cool, the tube including an interior wall having a converging section, followed by a diverging section.

In accordance with yet another aspect-of the present invention there is provided a melt spinning apparatus for spinning continuous polymeric filaments, comprising:

a housing adapted to be located below a spinneret;

a first stage chamber and a second stage chamber, each formed in an inner wall of the housing;

a first stage gas inlet for supplying gas to the first stage chamber;

a second stage gas inlet for supplying gas to the second stage chamber;

a wall attached to the inner wall at a lower portion of the first stage chamber to separate the first stage chamber from the second stage chamber;

a quench screen centrally positioned in the first stage chamber, wherein the apparatus is adapted such that pressurized gas is blown inwardly from the first stage gas inlet through the first stage chamber into a zone formed in the interior wall of the quench screen;

an inner wall disposed below the quench screen and between the first stage gas inlet and the second stage gas inlet;

a first stage converging section formed in the interior of the inner wall;

a perforated tube disposed below the first stage converging section and between the first stage gas inlet and the second stage gas inlet, the perforated tube being located centrally within the second stage chamber;

an inner wall located below the perforated tube;

a tube located in the interior of the inner wall, the tube including an interior wall surface having a second stage converging section located within the second stage chamber, and a diverging section located at the exit of the second stage chamber; and optionally a converging cone having perforated walls located at the exit of the tube.

In accordance with another aspect of the present invention there is provided a melt spinning process for spinning continuous polymeric filaments, comprising passing a heated polymeric melt in a spinneret to form filaments; providing a gas to the filaments from a gas inlet chamber located below the spinneret in a first stage; providing a gas to the filaments from a gas inlet chamber in a second stage;

passing the filaments to a tube located below the gas inlet chambers, wherein said tube comprises an interior wall having a first converging section; and passing the filaments through the tube.

In accordance with another embodiment of the present invention there is provided a melt spinning apparatus for spinning continuous polymeric filaments, comprising a tube to surround the filaments; two or more gas inlet chambers adapted to be located below a spinneret and which supply gas to the filaments to control the temperature of the filaments and further comprising at least one exhaust stage adapted to remove air from the apparatus.

In accordance with yet another aspect of the present invention there is provided a melt spinning process for spinning continuous polymeric filaments, comprising:

passing a heated polymeric melt in a spinneret to form filaments;

providing a gas to the filaments from a gas inlet chamber located below the spinneret in a first stage;

providing a means for gas to vent from at least one gas exhaust chamber located below the first stage;

passing the filaments through a tube located below the gas inlet chamber, wherein said tube comprises an interior wall having a first converging section that increases air speed; and allowing the filaments to exit the tube.

In yet another embodiment of the present invention there is provided a melt spinning apparatus for spinning continuous polymeric filaments, comprising a tube for surrounding the filaments; one or more gas inlets adapted to be located below a spinneret, at least one inlet including means to supply gas to the filaments above atmospheric pressure to control temperature of the filaments; and a vacuum exhaust to remove gas.

In another aspect of the present invention there is further provided a melt spinning apparatus for spinning continuous polymeric filaments, comprising a tube located below a gas inlet chamber for surrounding the filaments as they cool, the tube including an interior wall including a converging section for accelerating gas, followed by a diverging section.

In another embodiment of the present invention there is further provided a melt spinning apparatus for spinning continuous polymeric filaments, comprising:

a housing adapted to be located below a spinneret;

a first stage chamber, a second stage chamber, and a third stage chamber each formed in an inner wall of the housing;

a first stage gas inlet for supplying gas to the first stage chamber;

a second stage gas inlet for supplying or exhausting gas to or from the second stage chamber;

a third stage gas inlet for supplying gas to the third stage chamber; and a converging section in at least one of the stages or after the third stage, for accelerating gas.

In an embodiment of the present invention there is also provided a melt spinning apparatus for spinning continuous polymeric filament, comprising two or more gas inlet chambers adapted to be located below a spinneret and which supply gas to the filaments to control the temperature of the filaments;

at least one gas inlet for supplying gas to one or more of the inlet chambers;

at least one perforated annular plate separating the inlet chambers; and a tube for surrounding the filaments as they cool, the tube including an interior wall having a converging section, optionally followed by a diverging section.

In one aspect of the present invention there is also provide a method for cooling melt spun polyester filaments comprising providing a cooling gas to the filaments in at least two stages, and accelerating the gas between the stages.

In another aspect of the present invention there is provided a melt spinning apparatus for spinning continuous polymeric filament, comprising a tube for surrounding filaments, the tube including a diverging section with perforations and one or more gas inlets.

In yet another aspect of the present invention there is provided a melt spinning apparatus for spinning continuous polymeric filament, comprising a tube for surrounding filaments, one or more gas inlets, a means to introduce super atmospheric gas to at least one inlet, and a means to introduce ambient air to at least one inlet.

Further objects, features and advantages of the invention will become apparent from the detailed description that follows.

DETAILED DESCRIPTION OF THE ILLUSTRATED EMBODIMENT

Figure 1:
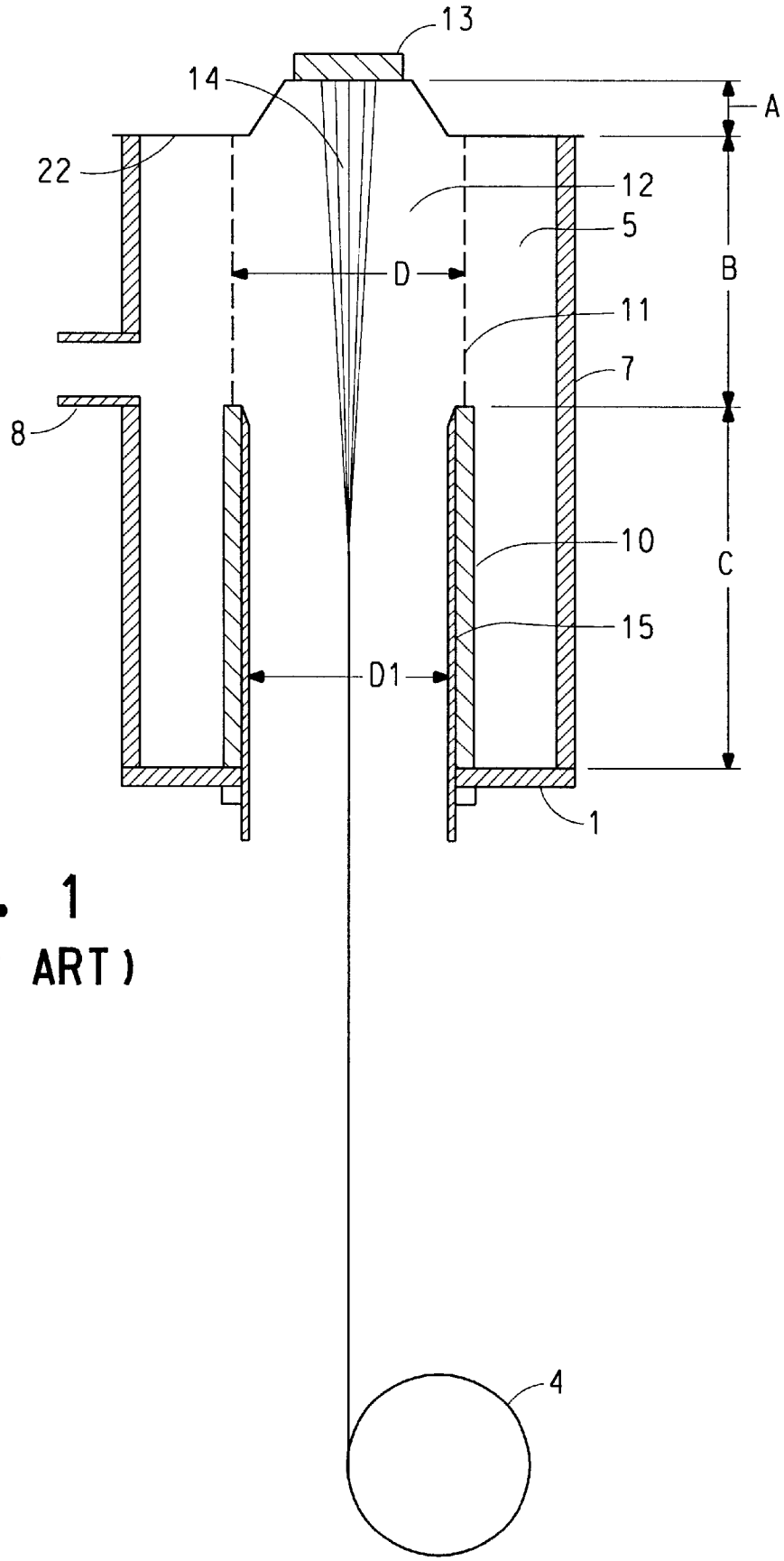
FIG. 1 (PRIOR ART)
FIG. 1. is a schematic elevation view partially in section of a comparative apparatus.

The present invention provides apparatuses and methods that allow for management of cooling gas, such that filament speed can be increased, thereby increasing productivity, while maintaining or improving product characteristics. In addition the methods can use less air than conventional processes thereby reducing expenses associated with higher air requirements.

The quenching system and process used as a control is a conventional radial quench system and is described with reference to FIG. 1 of the drawings. The radial quenching system used as a control includes a cylindrical housing 7 which forms an annular cooling gas supply chamber 5 that is pressurized with cooling gas blown in through gas supply inlet 8. Annular cooling gas supply chamber 5 is formed by a bottom wall 1, a centrally located cylindrical inner wall 10 and a cylindrical quench screen assembly 11 of similar diameter comprising one or more parts located atop inner wall 10. Preferably, the quench screen assembly 11 comprises a perforated tube around a wire mesh screen (not shown), which facilitate equal airflow and distribution. Pressurized cooling gas (such as air, nitrogen, or other gas) is uniformly supplied through quench screen assembly 11 from annular chamber 5 into zone 12 below spinneret 13 where an array of filaments 14 extruded from spinneret 13 begin to cool. Spinneret 13 is centrally located relative to housing 7 and can either be flushed with or recessed from the pump block (also referred to as a spin block or spin beam) bottom surface 22 against which housing 7 abuts. Filaments 14 continue through zone 12 and pass through tubular exhaust cylinder 15 (also referred to as the exhaust tube) out of the quench unit, down to puller roll 4, whose surface speed is termed the withdrawal speed of the filaments 14.

The following control quencher dimensions are shown in FIG. 1 and are specified in Example 1.

A—Quench Delay Height is the distance between the spinneret face and the pump-block bottom surface 22.

B—Quench Screen Height is the vertical length of the cylindrical quench screen assembly 11.

C—Exhaust Tube Height is the height of the tube through which filaments 14 leave the quencher after passing through the quench screen assembly 11.

D—Quench Screen Diameter is the inside diameter of the quench screen assembly.

D1—Exhaust Tube Diameter is the inside diameter of the exhaust tube.

Figure 2:
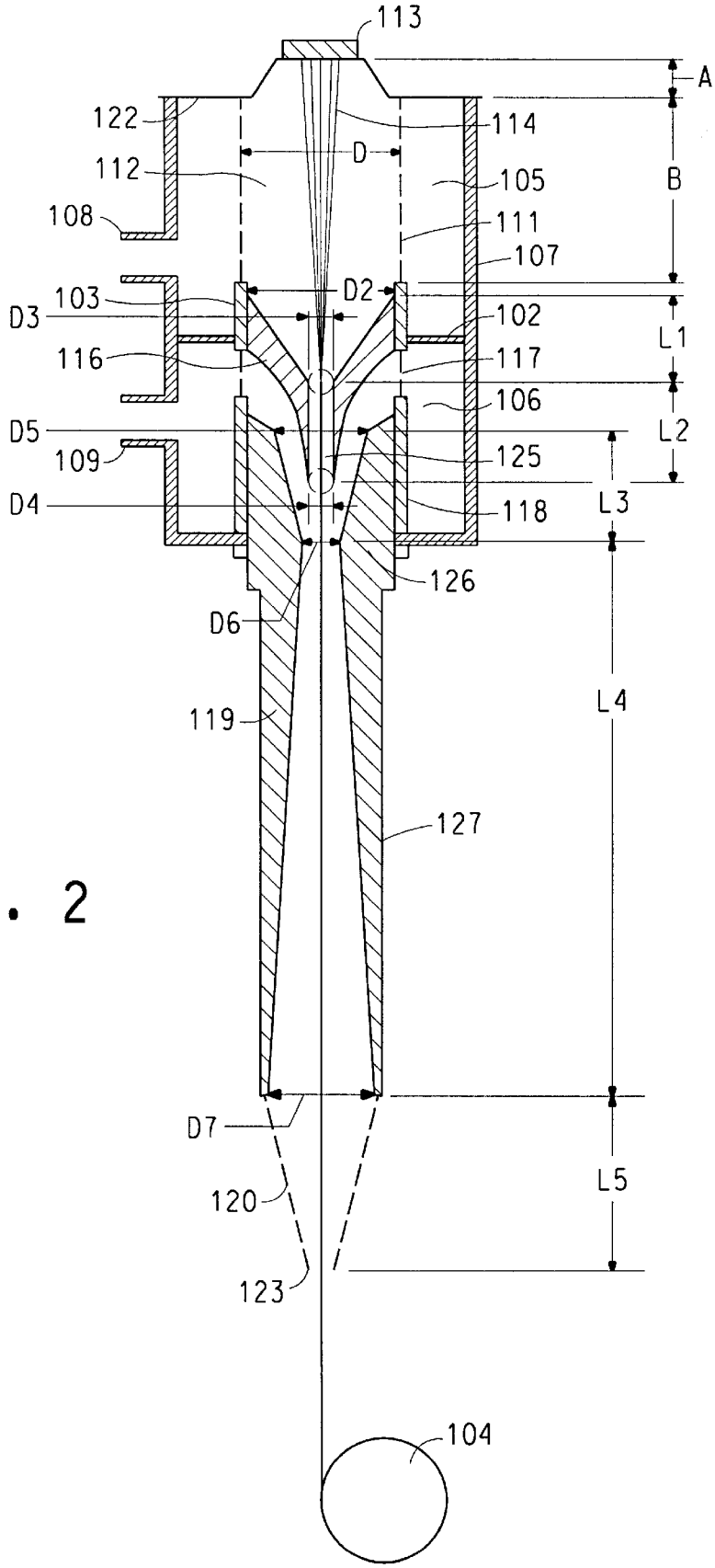
FIG. 2 is a schematic elevation view partially in section of one embodiment of the present invention, and as used in Examples 1 and 2.

In accordance with the present invention, there is provided a process and apparatus for spinning polymeric filaments. In general, gas is introduced to the apparatus via one or more inlets in one or more stages. The gas combines as it flows downward through the stages. The gas then exhaust out of the apparatus via an exit tube or wall. Some gas may exit the system through one or more exhaust stages and new gas may be added via subsequent gas inlets. An exemplary system is shown in FIG. 2. In FIG. 2, a two-stage quenching system in accordance with the present invention is illustrated. The process of the present invention will be described with respect to the operation of the apparatus as described below. This system comprises similar elements as in FIG. 1, such as an outer cylindrical housing 107 adapted to be located below a spinneret 113. Spinneret 113 is centrally located relative to housing 107 and is recessed from a pump-block bottom surface 122, as shown in FIG. 2, against which housing 107 abuts.

Figure 11:
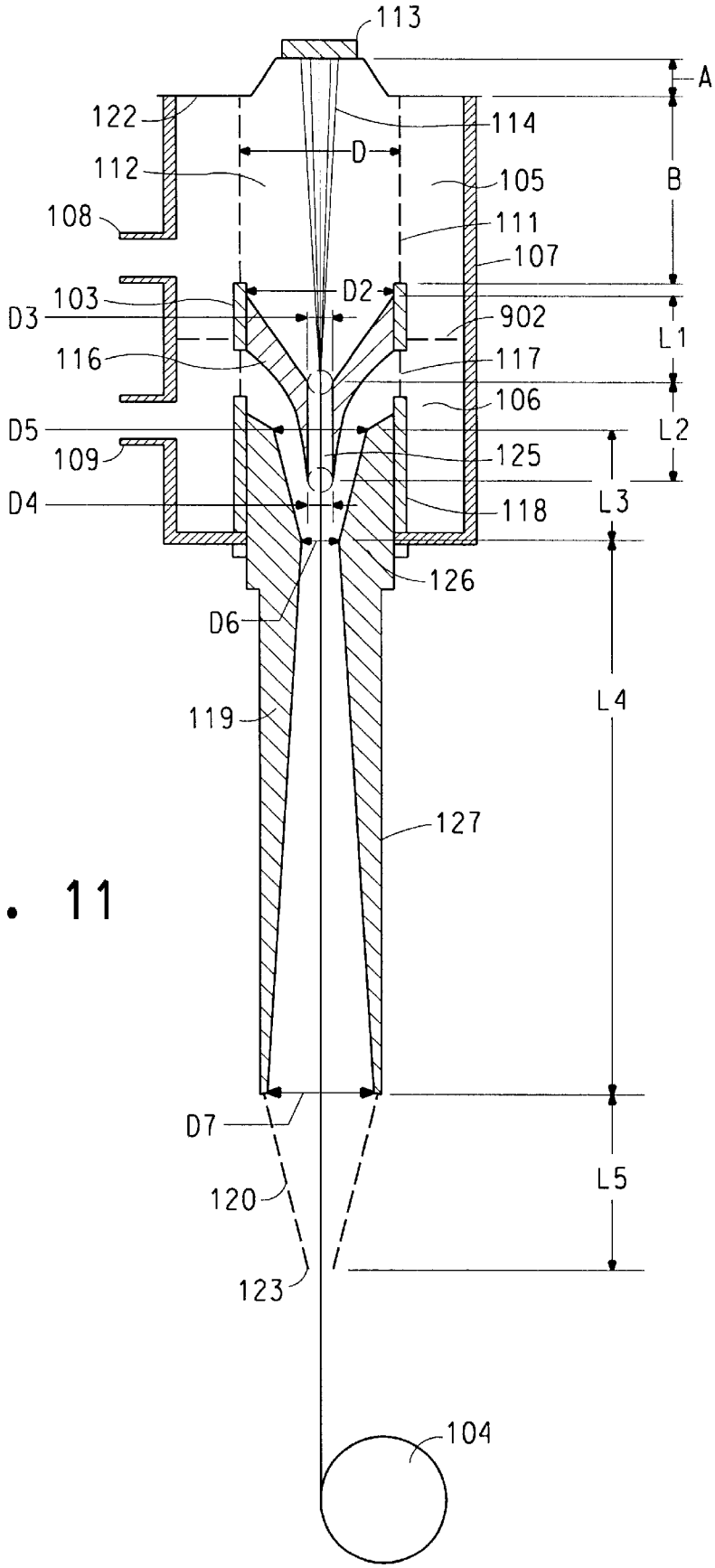
FIG. 11 is a schematic elevation view partially in section of a tenth embodiment of the present invention.

However, the quenching system and process according to the invention are different from the control shown in FIG. 1, in that, for example, the invention as shown in FIG. 2 comprises two stages, a converging section 116 for accelerating the air, and a converging diverging section in tube 119. A first stage chamber 105 and a second stage chamber 106 are each formed in the cylindrical inner wall of the housing 107. First stage chamber 105 is adapted to be located below a spinneret 113 and supplies gas to the filaments 114 to control the temperature of the filaments 114. Second stage chamber 106 is located between the first stage gas inlet 108 and a tube 119 located below the first gas flow inlet 108 for surrounding the filaments as they cool. An annular wall 102, which is attached to cylindrical inner wall 103 at the lower portion of the first stage chamber 105, separates the first stage chamber 105 from the second stage chamber 106. However, as shown in FIG. 11, in the apparatus of the present invention there can be a single gas inlet supplying one or more chambers. The number of gas inlets can be modified to allow flexibility in controlling gas flow. A first stage gas inlet 108 supplies gas to the first stage chamber 105. Similarly, a second stage gas inlet 109 supplies gas to the second stage chamber 106. Any gas may be used as a cooling medium. The cooling gas is preferably air, especially for polyester processing, because air is cheaper than other gas, but other gas may be used, for instance steam or an inert gas, such as nitrogen, if required because of the sensitive nature of the polymeric filaments, especially when hot and freshly extruded. The cooling gas flowing to each stage can be regulated independently by supplying pressurized cooling gas through inlets 108 and 109, respectively.

A cylindrical quench screen assembly 111, as in FIG. 1, comprising one or more parts, preferably a cylindrical perforated tube and a wire screen tube, is centrally positioned in the first stage chamber 105. In all embodiments of the present invention, the "perforated tube" is a means for distributing gas flow radially into a stage. A wire-mesh screen, an electro-etched screen, or a screen assembly comprising of wire mesh screens and perforated tube can be used. Pressurized cooling gas is blown inwards from first stage inlet 108 through first stage chamber 105 and through the cylindrical quench screen assembly 111 into a zone 112 formed in the interior cylindrical wall of the cylindrical quench screen assembly 111, below spinneret 113. A bundle of molten filaments 114, after being extruded through spinneret holes (not shown), pass through zone 112 where the filaments 114 begin to cool. An inner wall 103 is disposed below the cylindrical quench screen assembly 111 and between the first stage gas inlet 108 and the second stage gas inlet 109. A first stage converging section 116 is formed in the interior of housing 107, and more specifically in the interior wall of inner wall 103, between the first stage gas inlet 108 and the second stage gas inlet 109. The converging section can be located in any portion of the apparatus of the present invention, such that it accelerates the air speed. The converging section can be moved up or down the tube to achieve the desired gas management. There can be one or more such converging sections. Filaments 114 continue from zone 112 out of the first stage of the quenching system through a short tubular section of inner wall 103 before passing through first stage converging section 116, along with the first stage cooling gas, which accelerates in the filament travel direction as filaments 114 continue to cool.

A cylindrical perforated tube 117 is disposed below the first stage converging section 116 and between the first stage gas inlet 108 and the second stage gas inlet 109. The cylindrical perforated tube 117 is located centrally within the second stage chamber 106. However, the perforated tube can be located as desired to provide the desired gas to the filaments. For example, below the second stage gas inlet, a cylindrical inner wall 118 is located below the cylindrical perforated tube 117. A second supply of cooling gas is provided from the second stage supply inlet 109 by forcing the gas through cylindrical perforated tube 117. Between the first and second stage converging sections, 116 and 126 respectively, is a tubular section 125 formed by the inner walls of the converging section 116 of entrance diameter D3, exit diameter D4 and height L2. The tubular section 125 and converging section 116 can be formed as a single piece or formed as separate pieces that are connected together, for example by threading.

Figure 4:
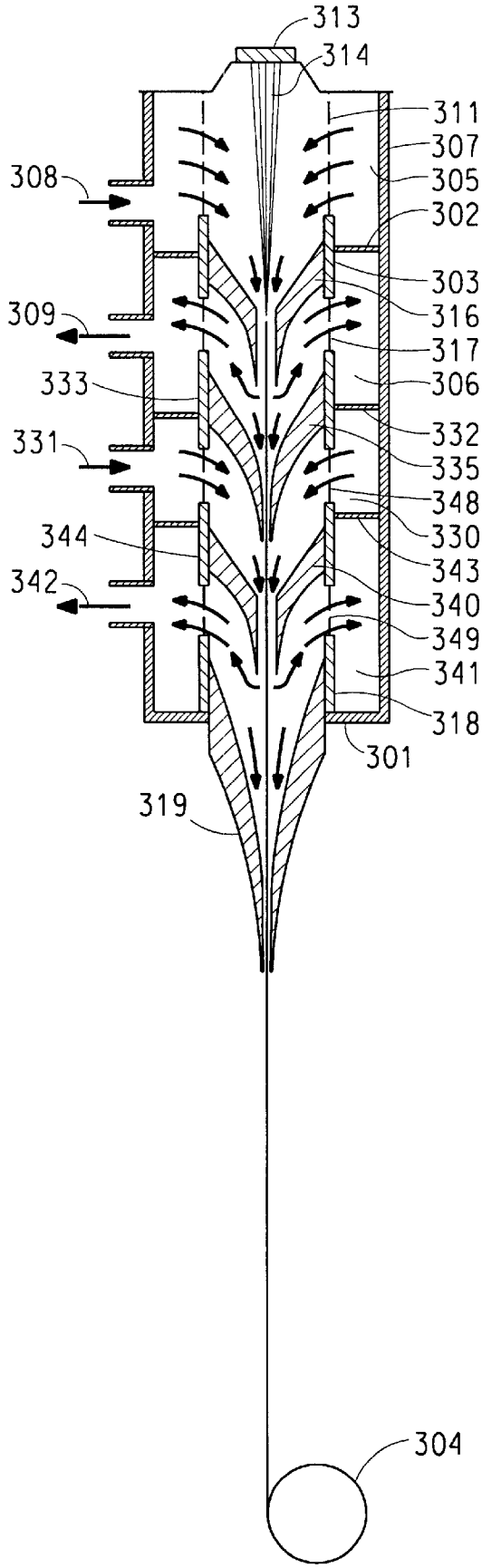
FIG. 4 is a schematic elevation view partially in section of a third embodiment of the present invention.

The tubular section 125 may be straight as shown in FIG. 2 or tapered as shown in FIG. 4. The ratio of diameters D2 to D4 is generally D4/D2<0.75 and preferably D4/D2<0.5. By use of such a ratio, the speed of the cooling air can be increased. The second stage cooling gas passes through the second stage converging section entrance, with diameter D5 created by the exit of tubular section 125 of the first converging section 116 and the entrance of spinning tube 119. The term spinning tube is used to refer to that portion of the apparatus having a converging diverging arrangement. Preferably, the last portion of the tube has such an arrangement. The upper end of the spinning tube 119 is located in the interior surface of cylindrical inner wall 118.

A second stage converging section 126 of length L3 and an exit diameter D6 is formed in the interior wall of tube 119, and is followed by a diverging section 127 of length L4, also formed in the interior wall of the tube 119, which extends to the end of the tube 119, which has an exit diameter D7. Filaments 114 leave the tube 119 through exit diameter D7 and are taken up by a roll 104 whose surface speed is termed the withdrawal speed of the filaments 114. The speed can be modified as desired. Preferably, the roll is driven at a surface speed of above 500 mpm, and for polyester, preferably above 3,500 mpm. The average velocity of the combined first and second stage gases increases in the filament travel direction in the second stage converging section 126 and then decreases as the cooling gas moves through the diverging-section 127. The second stage cooling gas combines with the first stage cooling gas in the second stage converging section 126 to assist with filament cooling. Cooling gas temperature and flow to inlets 108 and 109 may be controlled independently.

An optional converging screen 120, or diffuser cone, having perforated walls, may be located at the exit of spinning tube 119. Cooling gas is allowed to exhaust through the perforated walls of diffuser cone 120, which reduces the exit gas velocity and turbulence along the filament path. The other figures exemplify alternative means to exhaust the exit gas, such that there is reduced turbulence. Filaments 114 may leave the spinning tube 119 through the exit nozzle 123 of converging screen 120 and from there may be taken up by a roll 104.

In addition to height dimensions A and B defined earlier in FIG. 1, a preferred quencher according to the invention has the following dimensions:

L1—First Stage Converging Section Length

L2—First Stage Tube Length

D2—First Stage Converging Section Entrance Diameter

L3—Second Stage Converging Section Length

D3—First Stage Converging Section Tubular Section Entrance Diameter

D4—First Stage Converging Section Tubular Section Exit Diameter

L4—Second Stage Diverging Section Length

D5—Second Stage Converging Section Entrance Diameter

D6—Second Stage Converging Section Exit Diameter

D7—Second Stage Diverging Section Exit Diameter

L5—Optional Converging Screen Length

Although the apparatus illustrated in FIG. 2 is a two-stage apparatus, the optional converging screen 120 located at the exit of the tube 119 is applicable to a single-stage, as well as any multi-stage apparatus. Moreover, the converging sections, 116 and 126, shown in FIG. 2 prior to the exit of the tube 119, as well as the converging (126)/diverging (127) arrangement in the interior of the tube 119 may be applicable to any multi-stage device, or to a single stage device. The invention is not limited to two-stage devices. Gas can be introduced in 108 and 109, independently at atmospheric or increased pressure. Also, gas can be forced into gas inlet 109 above atmospheric pressure allowing gas to be sucked into 108. The same or different gases can be added in 108 and 109.

The delay (A) in FIG. 2 can be an unheated or heated delay. A heated delay (often termed an annealer) is used. The length and temperature of the delay can be varied to give desired cooling speed of the filaments.

In all embodiments of the invention, any desired type of wind-up could be used in addition to or in place of roll 204. For example, a 3-roll wind-up system can be used for continuous filament yarns, as shown by Knox in U.S. Pat. No. 4,156,071, with interlacing as shown therein, or for example, a so-called godet-less system, wherein yarn is interlaced and then wound as a package on the first driven roll 204 as shown in FIG. 3, or, for example, filaments that are not interlaced nor wound may be passed as a bundle of parallel continuous filaments for processing as tow, several such bundles generally being combined together for tow processing.

Figure 3:
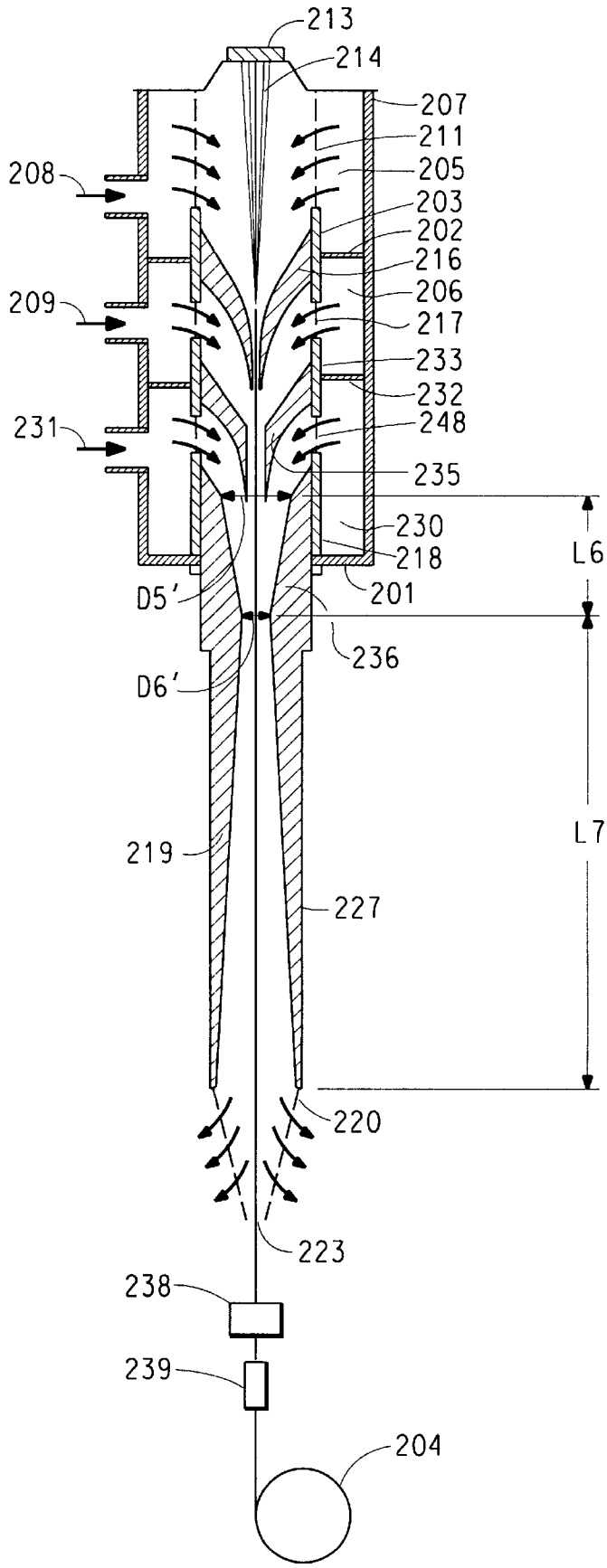
FIG. 3 is a schematic elevation view partially in section of a second embodiment of the present invention.

Referring to FIG. 3 a three-stage quenching system in accordance with the present invention is illustrated. In the figures, the single-headed arrows indicate the direction of gas flow. As in the two-stage quench system shown in FIG. 2, the system comprises an outer cylindrical housing 207 adapted to be located below a spinneret 213 and a cylindrical quench screen assembly 211 that generally comprises one or more parts. A first stage chamber 205, and a second stage chamber 206 are each formed in the cylindrical inner wall of the housing.

First stage chamber 205 is adapted to be located below spinneret 213 and supplies gas to the filaments 214 to control the temperature of the filaments 214. Second stage chamber 206 is located below the first stage chamber 205. The multi-stage system of FIG. 3 further comprises a third stage chamber 230 located below the second stage chamber 206 formed in the cylindrical inner wall of the housing.

As in FIG. 2, the annular wall 202, which is attached to cylindrical inner wall 203 at the lower portion of the first stage chamber 205, separates the first stage chamber 205 from the second stage chamber 206. Additionally in FIG. 3 a second annular wall 232 is attached to a second cylindrical inner wall 233 at the lower portion of the second stage chamber 230 and separates the second stage chamber 206 from the third stage chamber 230.

The first stage gas inlet 208 supplies gas to the first stage chamber 205, the second stage gas inlet 209 supplies gas to the second stage chamber 206, and the third stage gas inlet 231 supplies gas to the third stage chamber 230. A cylindrical perforated tube 217 is disposed below the first stage converging section 216 in the second stage chamber 206. Another cylindrical perforated tube 248 is disposed between a second stage converging section 235 and a third stage converging section 236. The cooling gas flowing to each stage can be regulated independently by supplying pressurized cooling gas through these inlets.

In FIG. 3, a first stage converging section 216 with continuous convergence is formed between the first stage gas inlet 208 and the third stage gas inlet 231. A second stage converging section 235 with a straight tube at the exit of the converging section is formed between the second stage gas inlet 209 and the bottom wall 201. A tube 219 comprising a converging section 236 then diverging section 227 extends from the third stage inlet 231. The upper end of the tube 219 is located in the interior surface of the cylindrical inner wall 218. A third stage converging section 236 of Length L6 having an entrance diameter D5' an exit diameter D6' is formed in the interior wall of the tube 219, and is followed by a diverging section 22 of length L7, also formed in the interior wall of the tube 219, which extends to the end of the tube 219. As in the embodiment shown in FIG. 2, filaments 214 leave the tube 219 through the exit nozzle 223 and are taken up by roll 204. An optional converging screen or perforated exhaust diffuser cone 220, as described above, is also shown in FIG. 3.

All embodiments of the apparatus of the present invention may also include a finish applicator 238 and an interlace jet 239, as shown in FIG. 3. Filaments 214, after leaving the quench systems continue down to roll 204. The roll 204 pulls filaments 214 in their path from the head spinneret so their speed at the roll 204 is the same as the surface speed of the roll 204, this speed being known as the withdrawal speed. As is conventional, a finish may be applied to the solid filaments 214 by the finish applicator 238 before they reach the roll 204.

The invention applies to partially oriented yarn (POY), highly oriented yarn (HOY), and fully drawn yarn (FDY) filament yarn processes. In POY and HOY processes, filament yarns are wound up at essentially the same speed as withdrawal speed. In FDY process, the yarn are mechanically drawn after withdrawal, and wound up at close to X times withdrawal speed, where X is the draw ratio.

The use of three stages, as in FIG. 3, can be advantageous because it allows for better control of the gas and more flexibility in cooling.

FIG. 4 shows a multi-stage quench system in accordance with the present invention. The system of FIG. 4 is similar to that of FIG. 2, but further includes two exhaust stages. The multi-stage quench system of FIG. 4, like the three-stage quench system of FIG. 3, comprises an outer cylindrical housing 307 adapted to be located below a spinneret 313 having three stages, 305, 306, and 330, similar to the three stages, 205, 206, and 230, shown in FIG. 3. However the modified quench system of FIG. 4 is different from that of FIG. 3 in that the second stage 306 is used as a first exhaust stage 309, instead of a second stage gas inlet 209, as shown in FIG. 3. The quench system of FIG. 4 further comprises a fourth stage chamber 341, which houses a second exhaust stage 342. The fourth stage chamber 341 is located below the third stage chamber 330 and is similar to the second stage 306. While FIG. 4 describes a specific arrangement of inlets and exhausts, the location and number of inlet and exhaust stages can be varied to allow for desired control of the cooling gas.

Gas may be introduced into the system in any desired manner. Generally, the first gas inlet 308 supplies gas to the first stage chamber 305, and the second gas inlet 331 supplies gas to the third stage chamber 330. The first stage chamber further comprises a cylindrical quench screen assembly 311 having one or more parts. The first exhaust stage 309 and the second exhaust stage 342 provide a system exhaust for the second stage chamber 306 and the fourth stage chamber 341, respectively. A cylindrical perforated tube 317 is disposed below a first converging section 316 and below the first gas inlet 308, in second stage 306. Another cylindrical perforated tube 348 is disposed between a second converging section 335 having a tapered end 350 and a third converging section 340. A third cylindrical perforated tube 349 is disposed between the third converging section 340 and tube 319. The cooling gas flowing to each chamber in the system of FIG. 4 may also be regulated independently by supplying pressurized cooling gas through the inlets.

Gas may be exhausted from the system in any desired manner. Generally, a vacuum or natural/atmospheric pressure is used. For example, the exhaust can merely release gas to the atmosphere at atmospheric pressure, or can remove gas by use of a vacuum. The exhaust removes hot air, and is used to control the cooling rate of the filaments.

FIG. 4 could optionally include a converging diverging section, for example, in the last stage, as in FIG. 2. The upper end of the tube 319 is located in the interior surface of the cylindrical inner wall 318. Tube 319 may alternatively be a straight tube like the exhaust tube shown in FIG. 1. As in the embodiment shown in FIG. 2, filaments 314 leave the tube 319 and are taken up by roll 304 in any desired manner.

Gas may be introduced to the system via gas inlets 308 and 331 by any means and may be atmospheric or pressurized. The supply and the exhaust may be arranged as desired, for example, alternating. In one embodiment fresh quench air is supplied through 308. The second stage chamber 306 is then used to remove a portion of the hot air from the first stage chamber 305. The rate of hot air being removed may be actively controlled by pressure at the first exhaust stage 309 and/or by proper sizing of the flow area of the cylindrical perforated tube 317 inside the second stage chamber 306 (relative to the flow area at the exit of the second converging section 335). After a portion of hot air is removed in the second stage chamber 306, more fresh quench air is supplied in the third stage chamber 330 as needed.

In the fourth stage chamber 341, a portion of hot air is again removed in a mariner similar to that of the second stage chamber 306. This is done mainly to improve thread-line stability/uniformity by reducing the total quench airflow in the direction of thread-line travel-which reduces high turbulence and large-scale jetting at the exit of the quench.

Figure 5:
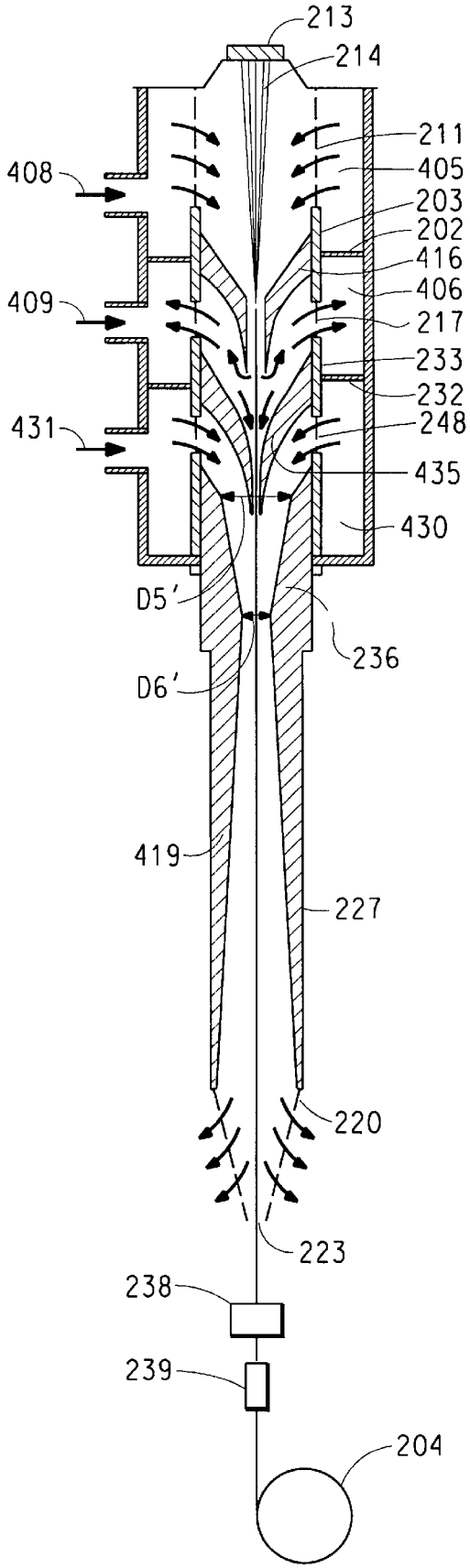
FIG. 5 is a schematic elevation view partially in section of a fourth embodiment of the present invention.

FIG. 5 shows another embodiment of FIG. 3, with elements like those of FIG. 3 designated by the same 200 series reference numerals and with elements not found in FIG. 3 designated by new 400 series reference numerals. The multi-stage system, shown in FIG. 5, provides an exhaust 409 for the second stage chamber 406. The system of FIG. 5, like the three-stage system of FIG. 3 comprises two converging sections, 416 and 435, a converging then diverging tube 419 and an optional converging screen 420 at the exit. The first gas inlet 408 supplies gas to the first stage chamber 405. The second gas inlet 209 is substituted for an exhaust stage 409, which removes gas from the second stage chamber 406. A third stage chamber 430, comprises a second gas inlet 431 that supplies gas to the third stage chamber 430. The cooling gas flowing in and out of each stage can be regulated independently by supplying cooling gas through these inlets.

The exhaust 409 can be like the exhaust of FIG. 4. Again, as in all the figures, the location of the diverging section can be varied to give desired speed to the gas. Also, a converging section is not required in FIG. 5, thus the tube can be a straight tube.

Similar to the embodiment discussed in FIG. 3, gas may be introduced to the system via gas inlets 408 and 431 by any means and may be atmospheric or pressurized. The supply and the exhaust may also be alternating. In one embodiment of the present invention fresh quench air is supplied as normal. The second stage chamber 406 is then used to remove a portion of the hot air from the first stage chamber 405. The rate of hot air being removed may be actively controlled by pressure at the first exhaust stage 409 and/or by proper sizing of the flow area of the cylindrical perforated tube 217 inside the second stage chamber 406 (relative to the flow area at the exit of the second converging section 435). After a portion of hot air is removed in the second stage chamber 406, more fresh quench air is supplied in the third stage chamber 430 as needed.

Figure 6:
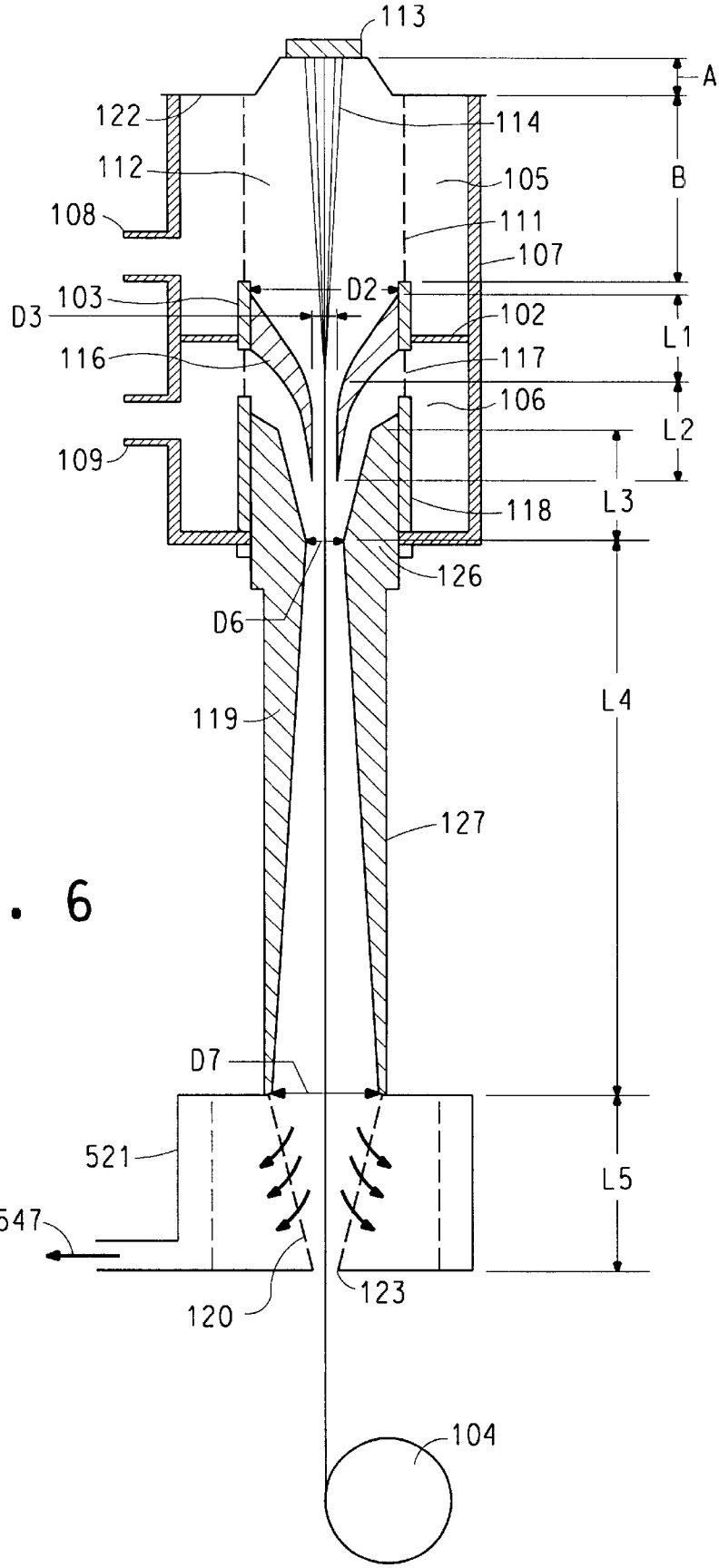
FIG. 6 is a schematic elevation view partially in section of a fifth embodiment of the present invention.

It should be apparent to those skilled in the art that variations of the present invention may be made without departing from the scope of the invention. For example, in FIG. 6 there is illustrated one such variation to the apparatus of FIG. 2 in which elements like those of FIG. 2 are designated by the same 100 series reference numerals, and where elements not found in FIG. 2 are designated by new 500 series reference numerals. In FIG. 6, an appropriate level of vacuum is applied on the outside of optional converging screen 120 via a vacuum box 521. This vacuum further facilitates the lateral exit of the gas, thereby minimizing the gas exit velocity and the associated gas turbulence in the spin-line direction. The vacuum box 521 may optionally comprise an optional perforated plate (not shown) positioned at the exit of the converging screen 120 and proximate a vacuum or suction outlet 547. The perforations allow the gas to exit quietly.

Figure 7:
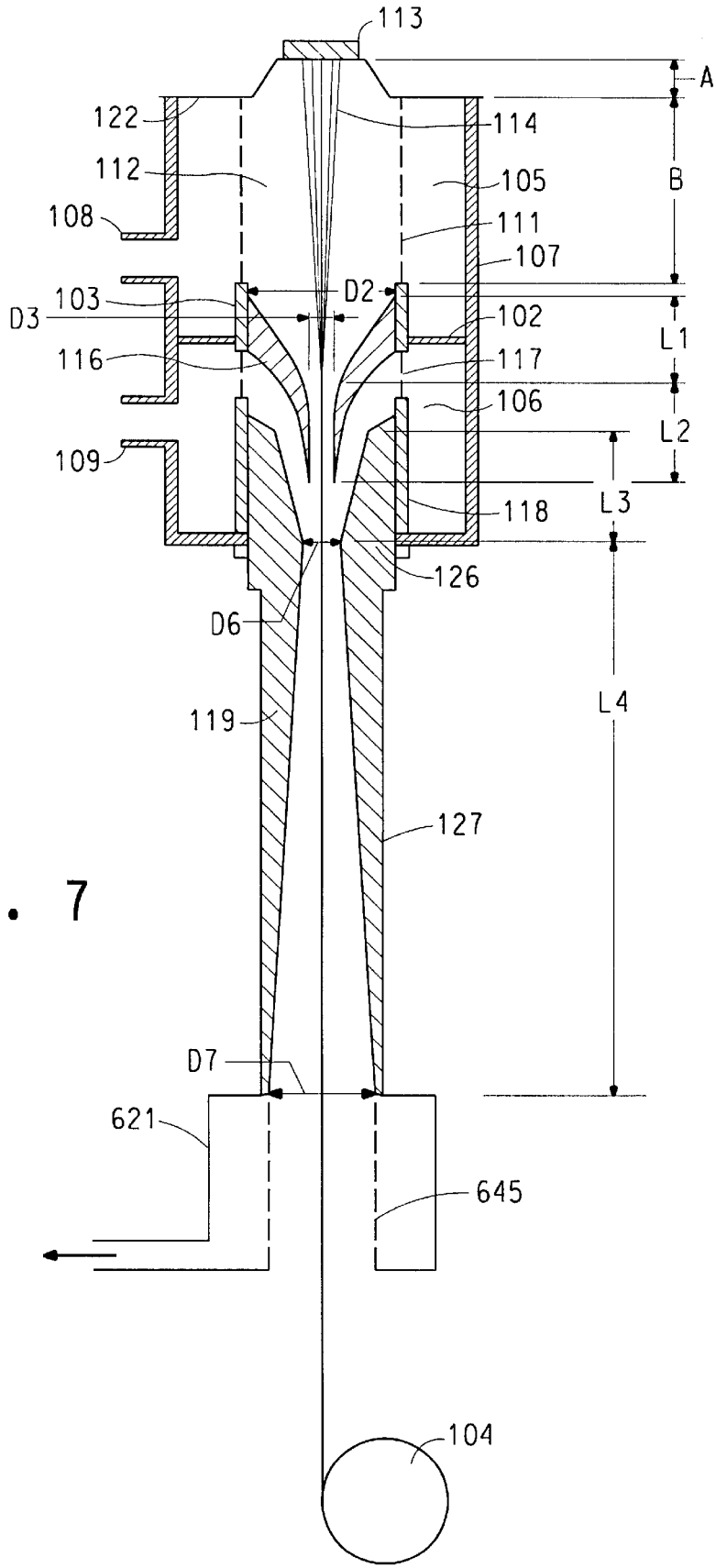
FIG. 7 is a schematic elevation view partially in section of a sixth embodiment of the present invention.

FIG. 7 illustrates a further variation of the apparatus of FIG. 2, with elements like those of FIG. 2 designated by the same 100 series reference numerals and with elements not found in FIG. 2 designated by new 600 series reference numerals. In this embodiment, the optional converging screen 120 is replaced by a straight wall tube 645, which is perforated to allow lateral gas to exit via a vacuum box 621.

Figure 8:
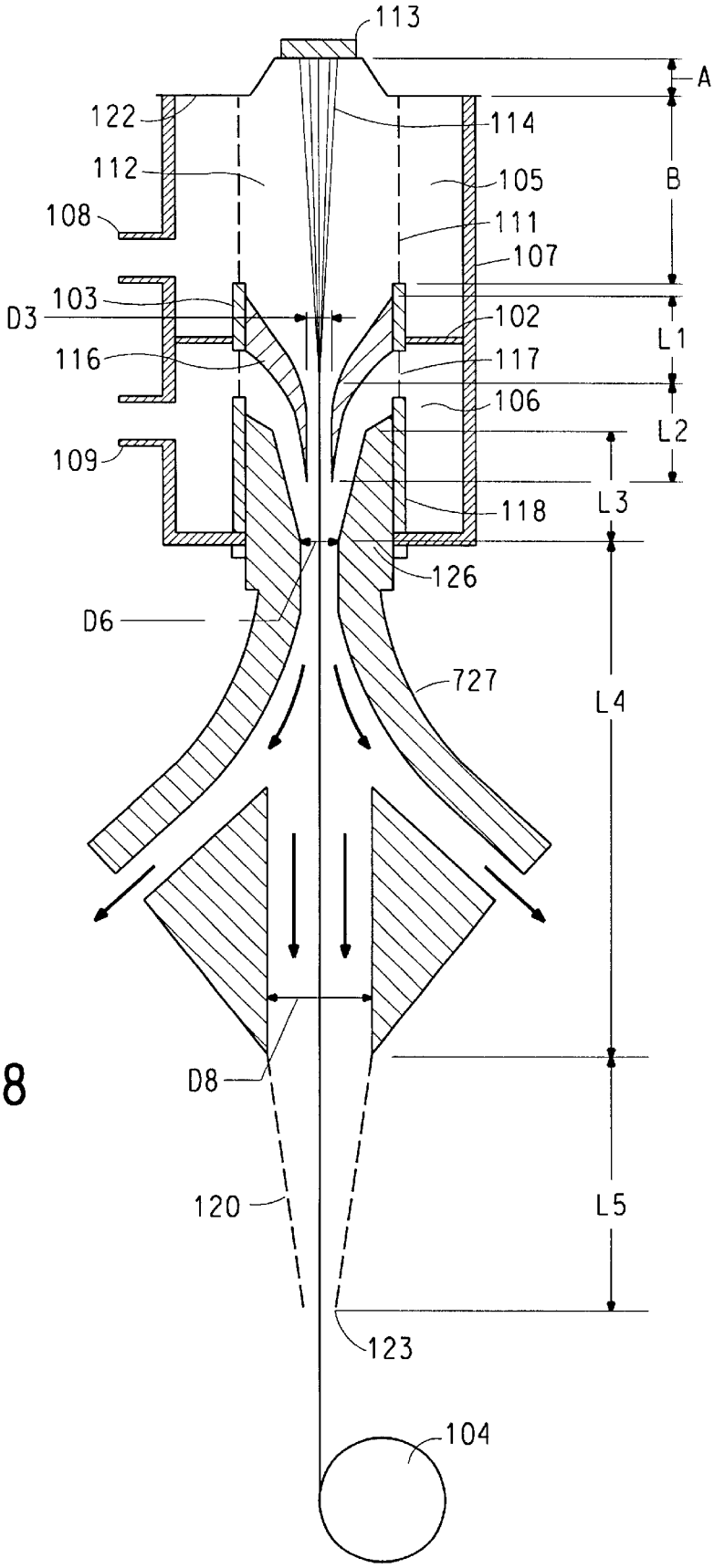
FIG. 8 is a schematic elevation view partially in section of a seventh embodiment of the present invention.
Figure 9:
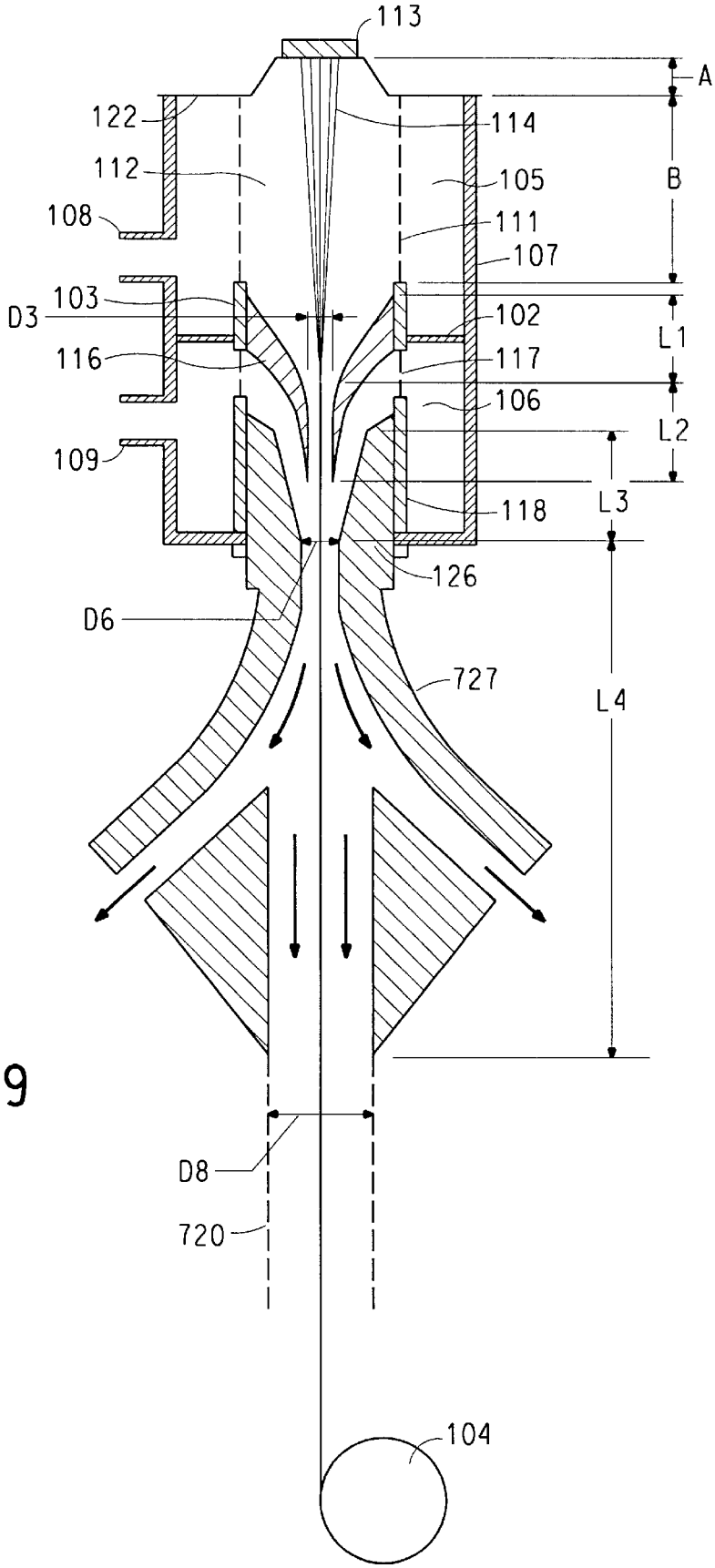
FIG. 9 is a schematic elevation view partially in section of an eighth embodiment of the present invention.

FIGS. 8 and 9 illustrate other embodiments of the present invention. Again, in these Figures, elements like those of FIG. 2 are designated by the same 100 series reference numerals, but with new 700 series reference numerals. FIG. 8 shows a two stage quench system having a first stage converging section 116 and a second stage converging section 126 and a curved diverging piece 727 that facilitates the gentle turn of the gas exiting D6 without an abrupt change of direction. The straight wall tube of a diameter D8, which is preferably at least two times larger than D6, allows the balance of the gas stream to flow downwards and exit quietly. There may also be provided an optional converging screen 120 having an exit nozzle 123, wherein the gas stream would flow downward through the optional converging screen 120 and exit nozzle 123. In FIG. 9, the apparatus is the same as that in FIG. 8, except that optional converging screen 120 is removed and replaced by a perforated tube 720 as in FIG. 7.

The configurations of FIGS. 6–9 have an analogous effect as that of the configuration of FIG. 2, i.e., they further facilitate the lateral exit of the gas, thereby minimizing the gas exit velocity and the associated gas turbulence in the spin-line direction. The concepts shown in FIGS. 6–9 apply equally well to quench apparatuses, with one or more gas inlets, and optionally one or more exhausts.

Figure 10:
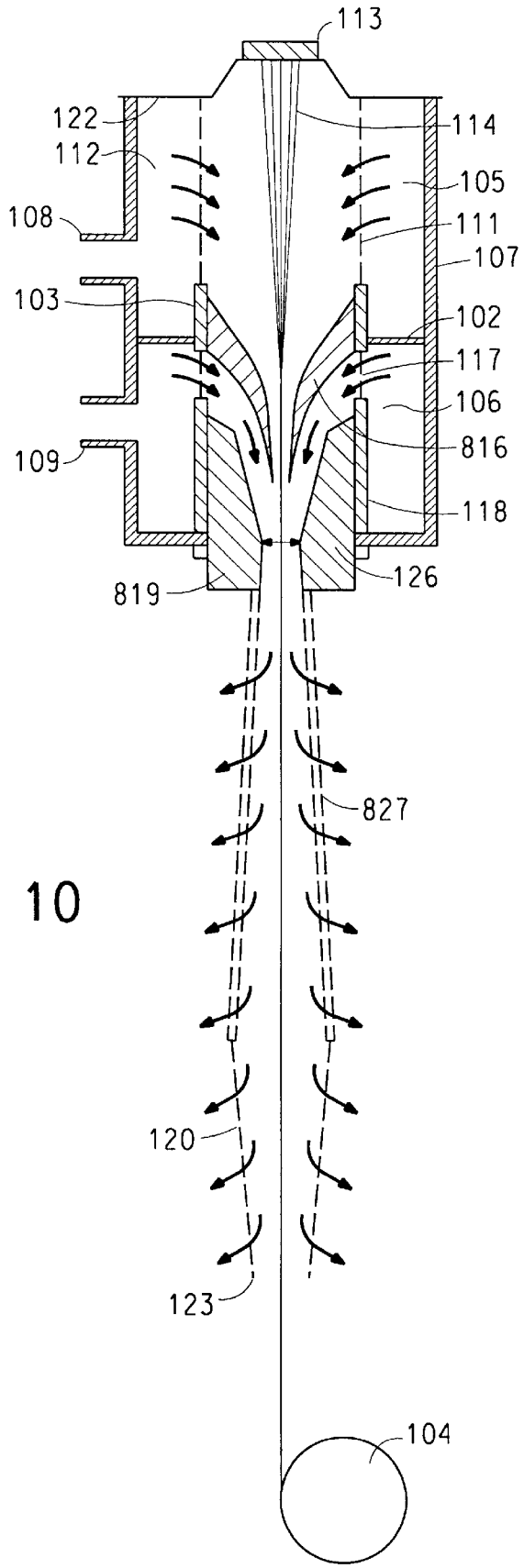
FIG. 10 is a schematic elevation view partially in section of a ninth embodiment of the present invention.

FIG. 10 illustrates a further variation of the apparatus of FIG. 2, with elements like those of FIG. 2 designated by the same 100 series reference numerals and with elements not found in FIG. 2 designated by new 800 series reference numerals. The invention as shown in FIG. 10 comprises two stages, a tapered converging section 816, for accelerating the air, and a converging diverging section in tube 819. All or a portion of the diverging section 827 is perforated to allow a portion of gas to exhaust while expanding and achieving similar effects as shown in FIGS. 6–9.

FIG. 11 illustrates a further variation of the apparatus of FIG. 2, with elements like those of FIG. 2 designated by the same 100 series reference numerals and with elements not found in FIG. 2 designated by new 900 series reference numerals. FIG. 11 shows a single inlet two stage apparatus in accordance with the present invention. The single inlet two stage apparatus is similar to that of FIG. 2, but has a single gas inlet. A first stage chamber 105 and a second stage chamber 106 are each formed in the cylindrical inner wall of the housing 107. First stage chamber 105 is adapted to be located below a spinneret 113. Second stage chamber 106 is located between the first stage chamber 105 and tube 119. A perforated annular wall 902, which is attached to cylindrical inner wall 103 at the lower portion of the first stage chamber 105, separates the first stage chamber 105 from the second stage chamber 106. Gas supplied via a second stage gas inlet 109 supplies gas to the second stage chamber 106 that flows through the perforated annular wall 902 to the first stage chamber 105. Thus, gas supplied through the second stage gas inlet supplies gas to the filaments in both the first and second stage chamber.

Figure 12:
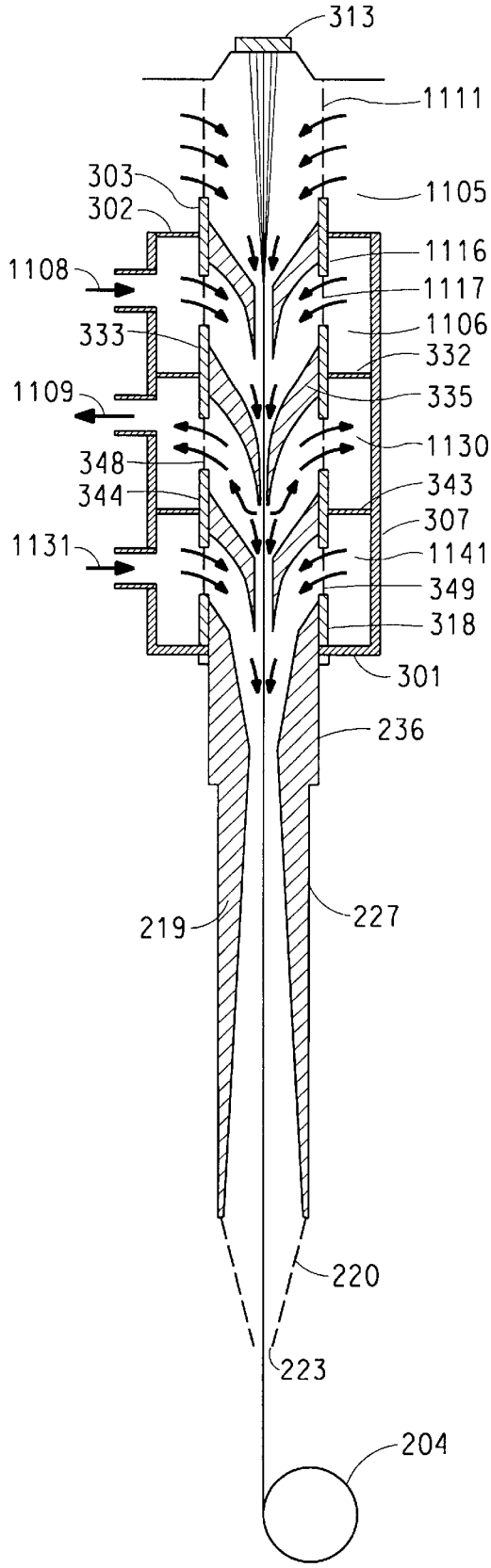
FIG. 12 is a schematic elevation view partially in section of an eleventh embodiment of the present invention.

FIG. 12 illustrates a variation of the apparatuses of FIG. 3 and FIG. 4, with elements like those of FIG. 3 and FIG. 4 designated by the same 200 and 300 series reference numerals and with elements not found in FIG. 3 and FIG. 4 designated by new 1100 series reference numerals. FIG. 12 shows a four stage apparatus in accordance with the present invention. The first stage 1105 is open to the atmosphere. Accelerating air in the second stage chamber 1106, which acts as an aspirator, induces gas flow into and through the first stage 1105. The second stage gas inlet 1108 gas supply is superatmospheric. High, accelerating air speed in the first converging section 1116 acts as an aspirator, pulling ambient (atmospheric) gas from the first stage 1105. An exhaust 1109 is provided for the third stage chamber 1130. Thus the third stage chamber 1130 is used to remove a portion of the hot air from the first and second stage chambers 1105 and 1106. The rate of hot air being removed may be actively controlled by pressure at the exhaust stage 1109 and/or by proper sizing of the flow area of the cylindrical quench screen assembly 1111 and/or perforated tube 1117. Gas is further introduced into the system via gas inlet 1131 in fourth stage chamber 1141, at atmospheric or superatmospheric pressure.

Figure 13:
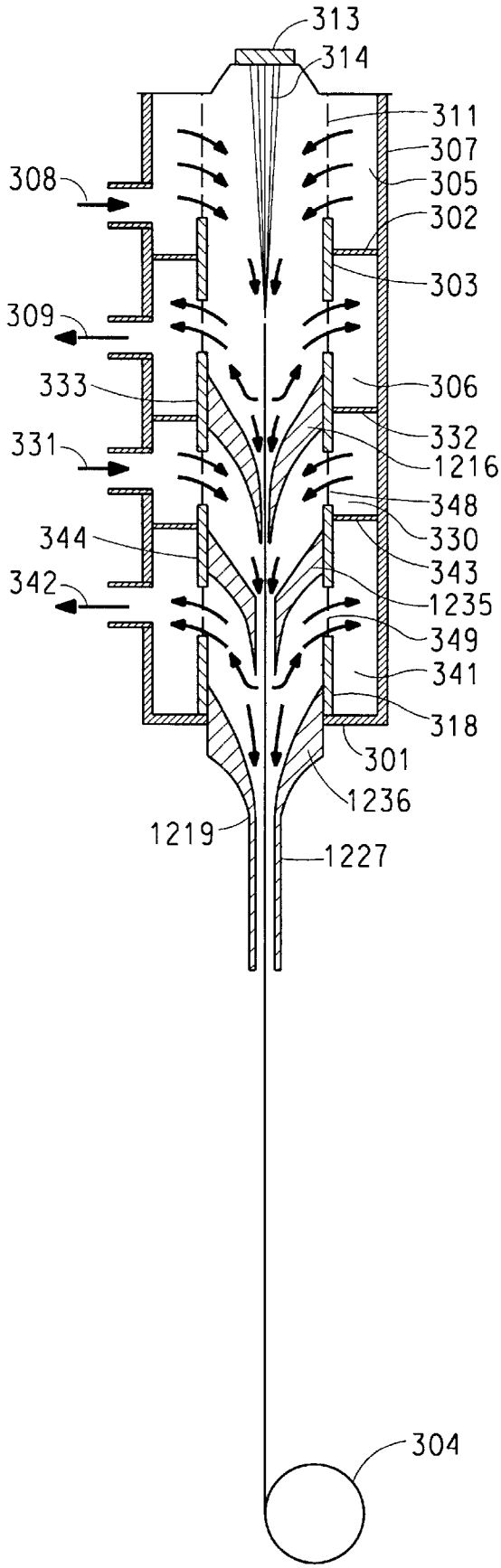
FIG. 13 is a schematic elevation view partially in section of a twelfth embodiment of the present invention.

FIG. 13 illustrates a further variation of the apparatus of FIG. 4, with elements like those of FIG. 4 designated by the same 300 series reference numerals and with elements not found in FIG. 4 designated by new 1200 series reference numerals. The invention as shown in FIG. 13 comprises a tube 1219 having a converging section 1236 and a straight section 1227 at the quench exit. The diameter and length of the straight section 1227 of the tube can be sized to provide optimal back pressure for controlling the amount of air being removed in the fourth stage chamber 341. Similarly, the converging section 1236 can be sized to provide bracing and stability to the air surrounding the filaments.

In FIG. 13, an annular wall 302, which is attached to cylindrical inner wall 303 at the lower portion of the first stage chamber 305, separates the first stage chamber 305 from the second stage chamber 306. A first converging section 1216 having a tapered or continuous convergence at the exit of the converging section is formed between the first exhaust stage 309 and annular wall 343. Another annular wall 332, attached to cylindrical inner wall 333 at the lower portion of the second stage chamber 306, separates the second stage chamber 306 from the third stage chamber 330. A second converging section 1235 is formed between the second gas inlet 331 and bottom wall 301. A third annular wall 343, which is attached to cylindrical inner wall 344 at the lower portion of the third stage chamber 330, separates the third stage chamber 330 from the fourth stage chamber 341.

The concepts shown in FIGS. 6–13 apply equally well to one or more stage quench apparatuses, with one or more gas inlets, and optionally one or more exhausts. A single stage can include one or more gas inlets or one or more gas exhausts or a combination of at least one exhaust and at least one inlet. In addition, the invention is not limited to circular and cylindrical geometry. For example, the quench screen, perforated tube, convergence and divergence sections can be rectangular or oval in cross-section, if the spinneret (filament) array has a rectangular or odd-shape cross-section.

The present invention is not limited to a quenching system that surrounds a circular array of filaments but can be applied more broadly, e.g., to other appropriate quenching systems that introduce the cooling gas to an appropriately configured array of freshly extruded molten filaments in a zone below a spinneret.

The above description and the following gives details of polyester filament preparation. However, the invention is not confined to polyester filaments, but may be applied to other melt-spinnable polymers, including, polyolefins, e.g., polypropylene and polyethylene. The polymers include copolymers, mixed polymers, blends, and chain-branched polymers, just as a few examples. Also the term filament is used generically, and does not necessarily exclude cut fibers (often referred to as staple), although synthetic polymers are generally prepared initially in the form of continuous polymeric filaments as they are melt-spun (extruded). The speed of the filaments will depend on the polymer used. But the invention apparatus can be used at higher speeds than the conventional systems.

EXAMPLES

The invention will now be exemplified by the following non-limiting examples. The conventional radial quenching system of FIG. 1 was used as a radial quench control, hereinafter referred to as "RQ Control A". The fibers produced in the examples were characterized by measuring certain properties.

Most of the fiber properties are conventional tensile and shrinkage properties, measured conventionally, as described in U.S. Pat. Nos. 4,687,610, 4,691,003, 5,141,700, 5,034,182, and 5,824,248.

Denier Spread (DS) is a measure of the along-end unevenness of a yarn by calculating the variation in mass measured at regular intervals along the yarn. Denier variability is measured by running yarn through a capacitor slot, which responds to the instantaneous mass in the slot. The test sample is electronically divided into eight 30 m subsections with measurements every 0.5 m. Differences between the maximum and minimum mass measurements within each of the eight subsections are averaged. The denier spread is recorded as a percentage of this average difference divided by the average mass along the whole 240 m of the yarn. Testing can be conducted on an ACW400/DVA (Automatic Cut and Weigh/Denier Variation Accessory) instrument available from Lenzing Technik, Lenzing, Austria, A-4860.

The Draw Tension (DT), in grams, was measured at a draw ratio of 1.7. times, and at a heater temperature of 180° C. Draw tension is used as a measure of orientation. Draw tension may be measured on a DTI 400 Draw Tension Instrument, also available from Lenzing Technik.

The Tenacity (Ten) is measured in grams per and elongation (E) is in %. They are measured according to ASTM D2256 using a 10 in (25.4 cm) gauge length sample, at 65% RH and 70 degrees F., at an elongation rate of 60% per min.

CFM was measured in inches of water.

An Uster Tester 3 Model C manufactured by Zellweger Uster AG CH-8610, Uster, Switzerland was used to measure the control and test yarn U %(N) irregularity of mass. The number in percent indicates the amount of mass deviation from the mean mass of the tested sample and is a strong indicator of the overall material uniformity. Testing was done following the ASTM Method D 1425. All yarns tested were run at 200 yds./min. for 2.5 minutes. The tester's Rotofil twister unit was set to provide S twist in the yarns and its pressure was adjusted to get the optimum U %. For 127-34, 170-34 and 115-100 POYs the pressure was 1.0 bar and 265-34 POY used 1.5 bar. A 1.0 bar pressure was also used for testing the 100-34 HOY products.

Example 1

A 127 denier, 34 round cross-section filament (127-34) polyester yarn was spun from poly (ethylene terephthlate) polymer using a quench system as described hereinbefore and illustrated in FIG. 2, having the primary apparatus parameters listed in Table 1 below, to produce yarn whose properties are also given in Table 1. First stage quench air is supplied (50 CFM, 23 l/sec) through a quench screen assembly 111, having an internal diameter D, below which is the first stage converging section of entrance diameter D2 and height L1. A tubular section 125 formed by the inner walls of the converging section 116 has an entrance diameter D3, exit diameter D4 and length L2. An independent, secondary source of cooling air (44 CFM, 20.5 l/sec.) is provided through cylindrical perforated tube 117 and combines with the first stage air supply at the entrance (diameter D5) of the second stage converging section 126. The second stage converging section 126 has exit diameter of D6 and convergence length L3 arid is positioned at the entrance of spinning tube 119. The lower portion of the spinning tube 119 diverges to diameter D7 over the length L4 and is fitted with a perforated exhaust diffuser cone 120 of height L5. For all examples and controls where applicable, the second stage perforated tube length 117 is 1.875 in. The apparatus according to the invention of Example 1 will hereinafter be referred to as "Embodiment A". The yarn spun with Embodiment A was at a withdrawal speed of 3,900 mpm.

For comparison, a control yarn was also spun from the same polymer using the quench system described earlier and illustrated with reference to FIG. 1, the relevant process and resulting yarn properties are also shown for comparison in Table 1. The control yarn process is a conventional "radial quench" design where cooling air exits the quencher through an exhaust tube 15 whose diameter is similar to the diameter of the quench screen assembly 11 through which cooling air is supplied. The quencher was supplied with 42 CFM (19.5 l/sec.) of cooling air and the yarn withdrawal speed was 3,100 mpm.

This example demonstrates that filament speed can be increased in the apparatus of the present invention, and yarn of comparable superior properties are achieved, as reflected by the approximate value of the denier spread. This example also demonstrates an important feature of the present pneumatic spinning invention, e.g. that one can spin at higher speeds (and productivities) producing the same or better product. If one attempted to operate at higher speeds, say 3,400 mpm and above, without the benefit of pneumatic spinning, the product would be different and, thereby, unacceptable. The draw tension would be high and the %Eb low. For example, if for Example 1 one would have run a control test (without pneumatic) at 3,900 mpm, the draw tension would likely have been about 140 gms (see column 8, lines 19–22 of U.S. Pat. No. 5,824,248). For polyester POYs, the draw tension practically characterizes the yarn. If the draw tensions of two samples are the same, then the %Eb, tenacity and other properties will be about the same.

TABLE 1

| Process Parameters | Control A | | Example 1 | |
|---|---|---|---|---|
| Quench Dimensions (in., cm.) | | | | |
| Quench Delay Height A | 3.5 | 8.9 | 3.5 | 8.9 |
| Quench Screen Height E | 6.5 | 16.5 | 6.5 | 16.5 |
| Exhaust Tube Height C | 14 | 35.6 | | |
| Quench Screen Diameter D | 4 | 10.2 | 4 | 10.2 |
| Exhaust Tube Diameter D1 | 3.75 | 9.5 | | |
| 1st Stage Converging Cone Height L1 | | | 5 | 12.7 |
| 1st Stage Tube Height L2 | | | 3 | 7.6 |
| 2nd Stage Converging Height L3 | | | 4.13 | 10.5 |
| 2nd Stage Diverging Height L4 | | | 17 | 43.2 |
| Perforated Exhaust Diffuser Cone Height L5 | | | 8 | 20.3 |
| 1st Stage Cone Entrance Diameter D2 | | | 3.75 | 9.5 |
| 1st Stage Tube Entrance Diameter D3 | | | 1 | 2.54 |
| 1st Stage Tube Exit Diameter D4 | | | 1 | 2.54 |
| 2nd Stage Convergence Entrance Diameter D5 | | | 1.75 | 4.45 |
| 2nd Stage Convergence Exit Diameter D6 | | | 1.5 | 3.81 |
| 2nd Stage Divergent Exit Diameter D7 | | | 2.5 | 6.35 |
| Yarn Parameters | | | | |
| Withdrawal Speed (mpm) | 3,100 | | 3,940 | |
| Number of Capillaries/Filaments | 34 | | 34 | |
| Denier (dtex) | 127 (141) | | 127 (141) | |
| Denier Spread, % | 1.05 | | 1.1 | |
| Draw Tension, grams | 63.4 | | 62.2 | |
| Tenacity, gpd, (g/dtex) | 2.84 (2.56) | | N.M. | |
| Elongation, Eb % | 140.2 | | N.M. | |

N.M. not measured

Example 2

A second 127-34 polyester yarn was spun using the same quench system as Example 1 except that the straight tube of entrance diameter D3 and exit diameter D4 located between the first and second stage converging cones, is tapered. The entrance diameter D3 is 1 inch, as in Example 1, but the section tapers to an exit diameter D4 of 0.75 inch which accelerates the first stage cooling gas through the converging section to a higher average velocity than if the section was straight. The modified apparatus of Example 1 described above will hereinafter be referred to as "Embodiment B". In Example 2 the first stage was supplied with 33 CFM (15.4 l/sec.) of cooling air while the second stage air supply was 35 CFM (16.3 l/sec.). The average air velocity of the exit of the first stage tube 125 for Example 2 was 17% higher than that in Example 1 (3225 v. 2755 mpm). The tapered tube allows an approximate 30% reduction in the total amount of cooling air consumption (68 (31.7 l/sec.) vs. 94 CFM (43.8 l/sec.) for 1st and 2nd stage air supply) required for the spinning process but yet provides comparable withdrawal speeds (~3900 mpm) or productivity and even more importantly improves the yarn uniformity by lowering the denier spread, i.e., 0.65 vs. 1.1%.

TABLE 2

| Process Parameters | Control A | | Example | |
|---|---|---|---|---|
| Quench Dimensions (in., cm.) | | | | |
| Quench Delay Height A | 3.5 | 8.9 | 3.5 | 8.9 |
| Quench Screen Height E | 6.5 | 16.5 | 6.5 | 16.5 |
| Exhaust Tube Height C | 14 | 35.6 | | |
| Quench Screen Diameter D | 4 | 10.2 | 4 | 10.2 |
| Exhaust Tube Diameter D1 | 3.75 | 9.5 | | |
| 1st Stage Converging Cone Height L1 | | | 5 | 12.7 |
| 1st Stage Tube Height L2 | | | 3 | 7.6 |
| 2nd Stage Converging Height L3 | | | 4.13 | 10.5 |
| 2nd Stage Diverging Height L4 | | | 17 | 43.2 |
| Perforated Exhaust Diffuser Cone Height L5 | | | 8 | 20.3 |
| 1st Stage Cone Entrance Diameter D2 | | | 3.75 | 9.5 |
| 1st Stage Tube Entrance Diameter D3 | | | 1 | 2.54 |
| 1st Stage Tube Exit Diameter D4 | | | 0.75 | 1.91 |
| 2nd Stage Convergence Entrance Diameter D5 | | | 1.75 | 4.45 |
| 2nd Stage Convergence Exit Diameter D6 | | | 1.5 | 3.81 |
| | | | 2.5 | 6.35 |
| Yarn Parameters | | | | |
| Withdrawal Speed (mpm) | 3,100 | | 3,900 | |
| Number of Capillaries/Filaments | 34 | | 34 | |
| Denier (dtex) | 127 (141) | | 127 (141) | |
| Denier Spread, % | 1.05 | | 0.65 | |
| Draw Tension, grams | 63.4 | | 66.4 | |
| Tenacity, gpd, (g/dtex) | 2.84 (2.56) | | 2.55 (2.30) | |
| Elongation, Eb % | 140.2 | | 125.3 | |

Example 3

This example demonstrates that other types of products can be spun and quenched using the apparatus of the present invention. For example yarns of any desired denier can be produced at higher speeds than conventional systems, by control of the air quench system according to the invention. The controls for these runs also include a commercially available BARMAG cross flow quench system (XFQ Control) and a second radial quench control, RQ Control B. The conventional cross flow quench system supplied 1278 cfm (603 liters/sec) per 6 threadlines through a diffusing screen of 47.2 inches (119.9 cm) length and 32.7 inches (83.1 cm) width and a cross-sectional area of 1543 $in^2$ (9955 $cm^2$). RQ Control B is a commercial radial quench diffuser whose geometry is shown in FIG. 1 except, D=3 inches and D1=2.75 inches and C=7.8 inches.

Results achieved are shown in Table 3. For all embodiments of the present invention and the controls where applicable, the second stage perforated tube length 117 is 1.875 in. For all runs except Run 3 the Quench Delay was 3.25 in.

Six different types of polyester yarn were spun using an apparatus according to FIG. 2. The first run was a 127-34 or 3.7 dpf polyester partially oriented yarn (POY) of light denier, which was spun using an XFQ Control at 3035 mpm, RQ Control A at 3100 mpm, Embodiment A at 3940 mpm, Embodiment B at 3900 mpm and Embodiment B with an annealer at 4500 mpm.

Other dimensions and parameters were as follows:

Control Spin block temperature=293° C.

Invention Spin block temp.=297° C.

Quench Airflow at 1st Stage

RQ Control A=42.0 CFM

Embodiment A=44.0 CFM

Embodiment B=33.0 CFM

Quench Airflow at 2nd Stage=35.0 CFM where applicable.

Embodiment A compared to the radial quench control shows that the invention provides similar products with a 27% higher spin speed.

Embodiment A versus Embodiment B compares results for a tapered cone section (1" diameter to 0.75" tube) versus a straight cone section (1" tube diameter). The results indicate that a tapered cone exit can provide better uniformity (% DS, U % (N)) was obtained while less air was used. The spin speed was about the same.

Embodiment B using an annealer in conjunction with the quench system similar to Embodiment B was also shown in this run. An annealer was used (200° C., 100 mm annealing length), in combination with a smaller apparatus having a first stage (1S) cone exit diameter (0.60"-dia. straight tube vs. 1.0/0.75 dia. for Embodiment B), much lower first stage airflow (19 CFM vs. 33 for Embodiment B), and lower polymer temperature (290 vs. 297 for Embodiment B). Spin speed increased to 4500 mpm with the annealer from 3900 mpm. This example shows another variation of the invention and the additive benefits when combining with other hardware such as an annealer. This example also demonstrates the ability for independent control of spinning productivity via design of first stage to maximize melt attenuation.

The next run was a 170-34 or 5 dpf polyester POY of medium denier, which was spun using RQ Control A at 3445 mpm, Embodiment A at 4290 mpm and Embodiment A at 4690 mpm.

Other dimensions and parameters were as follows:

Control Spin block temperature=291° C.

Invention Spin block temp.=293° C.

Quench Airflow at $1^{st}$ Stage

RQ Control A=58.0 CFM

Embodiment A (4290 mpm)=35.0 CFM

Embodiment A (4690 mpm)=44.0 CFM

Quench Airflow at $2^{nd}$ Stage

Embodiment A (4290 mpm)=35.0

Embodiment A (4690 mpm)=50.0

The RQ Control A was compared to Embodiment A at increased speeds for a mid-denier yarn. The results show the effects on spin productivity by increasing airflow in stages one and two. A productivity gain of 36.1% was obtained with 94 CFM vs. 24.5% with 70 CFM.

The third run was a 265-34 or 7.8 dpf polyester POY of heavy denier, which was spun using XFQ Control at 3200 mpm, RQ Control A at 3406 mpm and 42.0 CFM air flow at stage one, RQ Control A at 3406 mpm and 58.0 CFM air flow at stage one, Embodiment B at 4272 mpm and 29.5 CFM air flow at stage one, and Embodiment B at 4422 mpm and 33.0 CFM air flow at stage one.

Other dimensions and parameters were as follows

Spin Block Temp. for RQ Controls and the invention=281° C.

Quench Airflow at $1^{st}$ Stage

RQ Control A (42 CFM)=42.0

RQ Control A (58 CFM)=58.0

Embodiment B (29.5 CFM)=29.5

Embodiment B (33 CFM)=33.0

Quench Airflow at $2^{nd}$ Stage=35.0

Quench Delay=1.25 in.

The results of the third run showed the effects of increasing quench airflows on productivity for RQ Controls. No effects were seen when airflow was increased from 42 to 58 CFM (+38%). The results further show the effects of increasing quench airflows on productivity for the quench system of Embodiment B. Productivity increased to 29.8% from 25.4% when airflow was increased from 29.5 to 33 CFM (+11.9%).

Run 4 was performed using a 115-100 polyester micro POY on RQ Control B at 2670 mpm, Embodiment B at 3490 mpm and Embodiment B at 3500 mpm. The results showed that a comparable product could be produced at higher spin speeds for micro-denier yarn.

Other dimensions and parameters are as follows:

Spin Block Temp. +297° C.

Quench Airflow at $1^{st}$ Stage

RQ Control B=42.0

Embodiment B (3490 mpm)=29.5

Quench Airflow at $2^{nd}$ Stage=35.0

Run 5 was performed using a 170-100 or 170-34 polyester yarn. The 170-100 or 170-34 polyester yarn was spun using RQ Control B at 3200 mpm and Embodiment B at 4580 mpm. Again results showed that comparable product could be produced at higher spin speeds for micro-denier yarn.

A final run consisted of 100-34 HOY being spun on Embodiment B at 5000, 6000, 7000, and 7,500 mpm. The results showed that highly oriented yarn could be spun at high speeds.

TABLE 3

| | Product Den./No. filaments | | Spin Speed (mpm) | DT (grams) | % DS (%) | U % (N) (N) (%) | Ten. (g/d) | Elong. (%) | Prod. Gain (%) |
|---|---|---|---|---|---|---|---|---|---|
| Run 1 | | | | | | | | | |
| XFQ Control | 127–34 | POY | 3035 | 62.5 | 1.20–1.50 | | | | |
| RQ Control A | | | 3100 | 63.4 | 1.05 | 0.62 | 2.84 | 140.20 | |
| Embodiment A | | | 3940 | 66.8 | 0.87 | 0.86 | 2.62 | 129.3 | 27.1 |
| Embodiment B | | | 3900 | 66.4 | 0.65 | 0.74 | 2.55 | 125.3 | 28.5 |
| Embodiment B (with Annealer) | | | 4500 | 63.2 | 1.11 | | | | 45.2 |
| Run 2 | | | | | | | | | |
| RQ Control A | 170–34 | POY | 3445 | 101.5 | 1.58 | 0.81 | 2.93 | 129.0 | |
| Embodiment A | | | 4290 | 104.8 | 1.14 | 1.11 | 2.73 | 116.70 | 24.5 |
| Embodiment A | | | 4690 | 105.4 | 2.22 | 1.51 | 2.56 | 113.20 | 36.1 |

TABLE 3-continued

| | Product Den./No. filaments | | Spin Speed (mpm) | DT (grams) | % DS (%) | U % (N) (N) (%) | Ten. (g/d) | Elong. (%) | Prod. Gain (%) |
|---|---|---|---|---|---|---|---|---|---|
| Run 3 | | | | | | | | | |
| XFQ Control | 265–34 | POY | 3200 | 130 | 1.00–1.30 | <1.0 | | | |
| RQ Control A | | | 3500 | 137.2 | 3.66 | | | | |
| RQ Control A (42 CFM) | | | 3406 | 132.8 | 2.84 | 0.87 | 2.71 | 130.5 | |
| RQ Control A (58 CFM) | | | 3406 | 129.5 | 3.16 | 0.92 | 2.70 | 132.1 | |
| Embodiment B (29.5 CFM) | | | 4272 | 132.8 | 1.63 | 1.14 | 2.30 | 117.00 | 33.5 |
| Embodiment B (33 CFM) | | | 4422 | 132.3 | 1.80 | 1.26 | 2.25 | 114.70 | 38.2 |
| Run 4 | | | | | | | | | |
| RQ Control B | 115–100 | POY | 2670 | 69.9 | 0.84 | 2.13 | 2.84 | 141.9 | |
| Embodiment B | | | 3490 | 72.9 | 0.74 | 0.76 | 2.58 | 125.1 | 30.7 |
| Embodiment B | | | 3500 | 71.6 | 0.72 | 0.70 | 2.50 | 128.50 | 25.9 |
| Run 5 | | | | | | | | | |
| RQ Control B | 170–100 | POY | 3200 | 102.5 | | | | | |
| Embodiment B | | | 4580 | 102.2 | 0.92 | 1.06 | | | 43.1 |
| Run 6 | | | | | | | | | |
| Embodiment B | 100–34 | HOY | 5000 | 69.3 | 0.70 | 0.64 | 3.41 | 72.40 | |
| Embodiment B | | | 6000 | 130.2 | 0.67 | 0.66 | 3.94 | 58.60 | |
| Embodiment B | | | 7000 | 184.1 | 0.96 | 0.72 | | | |
| Embodiment B | | | 7500 | 200.7 | 0.79 | 0.90 | | | |

XFQ = cross flow quench
RQ = radial quench

Although the invention has been described above in detail for the purpose of illustration, it is understood that the skilled artisan may make numerous variations and alterations without departing from the spirit and scope of the invention defined by the following claims.

What is claimed is:

1. A melt spinning apparatus for spinning continuous polymeric filaments, comprising:

a first stage gas inlet chamber adapted to be located below a spinneret and a second stage gas inlet chamber located below the first stage gas inlet chamber wherein the first and second stage gas inlet chambers supply gas to the filaments to control temperature of the filaments; and a tube located below the second stage gas inlet chamber for surrounding the filaments as they cool, the tube including an interior wall having a converging section, followed by a diverging section.

2. The apparatus of claim 1, wherein a first stage converging section is formed between the first stage gas inlet chamber and the second stage gas inlet chamber.

3. A melt spinning apparatus for spinning continuous polymeric filaments, comprising:

a housing adapted to be located below a spinneret;

a first stage chamber and a second stage chamber, each formed in an inner wall of the housing;

a first stage gas inlet for supplying gas to the first stage chamber;

a second stage gas inlet for supplying gas to the second stage chamber;

a wall attached to the inner wall at a lower portion of the first stage chamber to separate the first stage chamber from the second stage chamber;

a quench screen centrally positioned in the first stage chamber, wherein the apparatus is adapted such that pressurized gas is blown inwardly from the first stage gas inlet through the first stage chamber into a zone formed in the interior wall of the quench screen;

an inner wall disposed below the quench screen and between the first stage gas inlet and the second stage gas inlet;

a first stage converging section formed in the interior of the inner wall;

a perforated tube disposed below the first stage converging section and between the first stage gas inlet and the second stage gas inlet, the perforated tube being located centrally within the second stage chamber;

an inner wall located below the perforated tube;

a tube located in the interior of the inner wall, the tube including an interior wall surface having a second stage converging section located within the second stage chamber, and a diverging section located at the exit of the second stage chamber; and optionally a converging cone having perforated walls located at the exit of the tube.

4. A melt spinning process for spinning continuous polymeric filaments, comprising:

passing a heated polymeric melt in a spinneret to form filaments;

providing a gas to the filaments from a gas inlet chamber located below the spinneret in a first stage;

providing a gas to the filaments from a gas inlet chamber in a second stage;

passing the filaments to a tube located below the gas inlet chambers, wherein said tube comprises an interior wall having a first converging section; and passing the filaments through the tube.

5. The process of claim 4, wherein the filaments leave the tube and are taken up by a take-up roll, wherein the roll is driven at a surface speed of at least 500 meters per minute.

6. The process of claim 4, where, in the gas inlet chamber in the first-stage, pressurized gas is blown inwardly into a zone where the filaments begin to cool.

7. The process of claim 4, wherein the filaments arid the gas pass through the first converging section, wherein the gas accelerate in the filament travel direction as the filaments continue to cool.

8. The process of claim 4, wherein pressurized gas is blown inwardly from the second stage gas inlet, arid the second stage gas combines with the first stage gas in a converging section to assist with filament cooling.

9. The process of claim 8, wherein the combined first and second stage gas velocity increases in the filament travel direction in the converging section and then decreases as the cooling gas moves through a diverging section, located within the tube.

10. A melt spinning apparatus for spinning continuous polymeric filaments, comprising:

a tube to surround the filaments, wherein the tube includes a diverging section following a converging section;

two or more gas inlet chambers adapted to be located below a spinneret and which supply gas to the filaments to control the temperature of the filaments and further comprising at least one exhaust stage adapted to remove air from the apparatus.

11. A melt spinning apparatus for spinning continuous polymeric filaments, comprising:

a tube to surround the filaments;

two or more gas inlet chambers adapted to be located below a spinneret and which supply gas to the filaments to control the temperature of the filaments and further comprising at least one exhaust stage adapted to remove air from the apparatus;

a converging section in the tube located below at least one of the gas inlet chambers.

12. The apparatus of claim 11, wherein said converging section comprises a tapered end.

13. A melt spinning process for spinning continuous polymeric filaments, comprising:

passing a heated polymeric melt in a spinneret to form filaments;

providing a gas to the filaments from a gas inlet chamber located below the spinneret in a first stage, wherein said gas is supplied to said gas inlet chamber from a superatmospheric supply;

providing a means for gas to vent from at least one gas exhaust chamber located below the first stage;

passing the filaments through a tube located below the gas inlet chamber, wherein said tube comprises an interior wall having a first converging section that increases air speed; and allowing the filaments to exit the tube.

14. A melt spinning process for spinning continuous polymeric filaments, comprising:

passing a heated polymeric melt in a spinneret to form filaments;

providing a gas to the filaments from a gas inlet chamber located below the spinneret in a first stage chamber;

providing a means for gas to vent from at least one gas exhaust chamber located below the first stage in a second stage chamber;

providing a gas to the filaments from a gas inlet chamber in a third stage chamber, wherein said gas is supplied to said gas inlet chamber from a superatmospheric supply;

passing the filaments through a tube located below the gas inlet chamber, wherein said tube comprises an interior wall having a first converging section that increases air speed; and allowing the filaments to exit the tube.

15. The process of claim 13, wherein filaments pass through a diverging section of the tube after passing through the converging section.

16. A melt spinning apparatus for spinning continuous polymeric filaments, comprising:

a tube for surrounding the filaments;

one or more gas inlets adapted to be located below a spinneret, at least one inlet including means to supply gas to the filaments above atmospheric pressure to control temperature of the filaments; and a vacuum exhaust to remove gas, wherein at least one inlet supplies ambient air, wherein the ambient air is pulled in by the gas above atmospheric pressure.

17. A melt spinning apparatus for spinning continuous polymeric filaments, comprising:

a housing adapted to be located below a spinneret;

a first stage chamber, a second stage chamber, and a third stage chamber each formed in an inner wall of the housing;

a first stage gas inlet for supplying gas to the first stage chamber;

a second stage gas inlet for supplying or exhausting gas to or from the second stage chamber;

a third stage gas inlet for supplying gas to the third stage chamber; and a converging section in at least one of the stages or after the third stage, for accelerating gas.

18. The apparatus of claim 17, further comprising a tube located below the third stage gas inlet for surrounding the filaments as they cool, the tube including an interior wall having a diverging section.

19. A melt spinning apparatus for spinning continuous polymeric filament, comprising two or more gas inlet chambers adapted to be located below a spinneret and which supply gas to the filaments to control the temperature of the filaments;

at least one gas inlet for supplying gas to one or more of the inlet chambers;

at least one perforated annular plate separating the inlet chambers; and a tube for surrounding the filaments as they cool, the tube including an interior wall having a converging section, optionally followed by a diverging section.

20. A melt spinning apparatus for spinning continuous polymeric filament, comprising:

a tube for surrounding filaments;

two or more gas inlets;

means to introduce superatmospheric gas to at least one inlet; and means to introduce ambient air to at least one inlet.

* * * * *